US007448793B2

(12) United States Patent
Kurosawa

(10) Patent No.: US 7,448,793 B2
(45) Date of Patent: Nov. 11, 2008

(54) EMULSION PRODUCTION APPARATUS

(75) Inventor: Keiji Kurosawa, Chiba (JP)

(73) Assignees: Value Supplier & Developer Corporation, Noda-shi, Chiba (JP); Kabushiki Kaisha Fujimi Plant, Nagoya, Aichi (JP)

( * ) Notice: Subject to any disclaimer, the term of this patent is extended or adjusted under 35 U.S.C. 154(b) by 0 days.

(21) Appl. No.: 12/018,251

(22) Filed: Jan. 23, 2008

(65) Prior Publication Data

US 2008/0181052 A1 Jul. 31, 2008

(30) Foreign Application Priority Data

Jan. 26, 2007 (JP) ..... 2007-016369

(51) Int. Cl.
*B01F 7/28* (2006.01)

(52) U.S. Cl. ..... 366/170.4; 366/172.2; 366/305

(58) Field of Classification Search ..... 366/64–66, 366/96–99, 169.1, 170.4, 172.1, 172.2, 174.1, 366/175.2, 176.1, 176.2, 292–295, 305; 516/928–931
See application file for complete search history.

(56) References Cited

U.S. PATENT DOCUMENTS

| | | | | |
|---|---|---|---|---|
| 2,969,960 | A * | 1/1961 | Gurley, Jr. | |
| 2,970,817 | A * | 2/1961 | Gurley, Jr. | |
| 2,995,346 | A * | 8/1961 | Samples | |
| 3,744,763 | A * | 7/1973 | Schnoring et al. | |
| 4,213,712 | A * | 7/1980 | Aanonsen et al. | |
| 4,421,413 | A * | 12/1983 | Sekiguchi | |
| 4,886,368 | A * | 12/1989 | King | |
| 5,511,877 | A | 4/1996 | King | |
| 5,563,189 | A * | 10/1996 | Hosokawa et al. | |
| 6,386,751 | B1 * | 5/2002 | Wootan et al. | |
| 7,131,604 | B2 | 11/2006 | Enomura | |
| 7,186,018 | B2 * | 3/2007 | Burak | |
| 2003/0193834 | A1 * | 10/2003 | Stache | |
| 2008/0106969 | A1 * | 5/2008 | Kojima | |

FOREIGN PATENT DOCUMENTS

| | | |
|---|---|---|
| DE | 10133775 | 9/2002 |
| DE | 102006018714 | 10/2007 |
| EP | 1093843 A1 * | 4/2001 |
| EP | 1241407 | 9/2002 |

(Continued)

OTHER PUBLICATIONS

European Patent Office Search Report dated May 6, 2008 for Application No. 08001125, Reference No. AMA032-13857E. See treatment of references for concise statement for foreign citations 2-4 above.

*Primary Examiner*—Charles E Cooley
(74) *Attorney, Agent, or Firm*—Banner & Witcoff, Ltd

(57) ABSTRACT

An emulsion production apparatus comprises a first rotor 9 which is fixed to a rotary hollow shaft 7 to atomize mixture liquid supplied from a mixture liquid pipe 2 at a portion below the mixture liquid pipe 2, an intermediate support body 15 which is disposed above the first rotor 9 and compresses the mixture liquid which has passed through the first rotor 9, and a second rotor 18 which is fixed to the hollow shaft 7 so as to further atomize the liquid which has passed through long holes 16 disposed in the support body 15.

11 Claims, 2 Drawing Sheets

FOREIGN PATENT DOCUMENTS

| | | | | |
|---|---|---|---|---|
| EP | 1475566 | | | 11/2004 |
| JP | 02-105890 | | | 4/1990 |
| JP | 06114254 | A | * | 4/1994 |
| JP | 08-209157 | | | 8/1996 |
| JP | 2004-161943 | | | 6/2004 |
| JP | 2005133135 | A | * | 5/2005 |

* cited by examiner

EMULSION PRODUCTION APPARATUS

BACKGROUND OF THE INVENTION

1. Field of the Invention

This invention relates to an emulsion production apparatus. More specifically, the present invention relates to an apparatus for producing emulsion fuel with high stability for use as low-pollution fuel.

2. Description of the Related Art

Emulsion fuel, in which water is added to a fuel oil such as light oil, heavy oil and heavy gravity oil to bee stirred and water is dispersed in the fuel oil, has been well known. Here, the heavy gravity oil is oil which is poor in flow-ability in room temperatures and does not flow without being heated at high temperatures, and includes the following oil in which an ingredient having a boiling point of 340° C. or more at ordinary pressure is preferably contained 90 wt. % or more. The oil includes a king of petroleum asphalt and its oil mixtures, various types of resultant products of petroleum asphalt, their intermediate products, residual dross and mixtures thereof, a high fluid-point oil which does not flow at room temperatures or a crude oil, petroleum tar pitch and its oil mixtures, a kind of bitumen, natural asphalt, orinoco tar, tar, a resultant-product oil.

When the emulsion fuel is sprayed into a high temperature field, the water in fuel liquid droplets is immediately boiled, the fuel liquid droplets are atomized (micro explosion), thereby burning at high speed and with high efficiency is actualized, and occurrences of CO and smoke may be suppressed. Since flame temperatures are decreased by the evaporation of water and NOx in an exhaust gas is effectively reduced, the emulsion fuel has been known as the low-pollution fuel.

In producing the emulsion fuel, the quality of performance of a mixer strongly affects on burning performance and long-term stability of the produced emulsion fuel. As regards the conventional mixer, specifically, an in-line type mixer, a static mixer, a high-pressure homogenizer, etc., have been utilized.

In the case of the static mixer, a fin column of which the twisting directions alternately invert is inserted so that fluids advance into a pipe while alternately rotating.

In contrast, in the case of the homogenizer, it blows out the fluids from fine nozzles under high pressure from several hundred to several thousand atmospheric pressure, and accelerates a fine mixture by strong shearing force caused by the blowing.

Furthermore, a technique is disclosed, with which the emulsion fuel is collided with each other by pressing it out from a pump or by jet blowing it out from the nozzles at high speed, agitated with a rotor, also allowed to pass through a magnetic field applying apparatus to tear off each molecule cluster of micelle particles, and with which accelerates mixture and diffusion of the micelle particles by electromotive power, and reduces particle diameters. For instance, refer to Jpn. Pat. Appln. KOKAI Publication No. 2004-161943.

With respect to the heavy gravity oil such as asphalt and oil sand, a production method for producing the emulsion fuel is disclosed, which includes steps of pre-mixing each row material, which is supplied from a heavy gravity oil tank, an emulsifying agent tank and a water tank which are kept at predetermined temperatures by a fixed quantity pump by a static mixer, agitating the row material by means of a high-shearing mixer (here, a pipe-line homo-mixer made by TOKUSHU KIKA KOGYOU CO., LTD. is used) and transferring the emulsion fuel to a heavy gravity oil emulsion fuel tank through a temperature regulator, for example, in Jpn. Pat. Appln. KOKAI Publication No. 8-209157.

Generally, the emulsion fuel itself is not stable with time as emulsion fuel. That is, the emulsion fuel in which only water is converted into fine particles to disperse into oil is agglutinated and separated into two phases of the oil in an upper layer and the water in a lower layer in due course of time. It is impossible for such fuel in which the oil and the water are separated into two phases to be used as fuel. Therefore, it is necessary to secure the dispersion stability with time in transportation and storage. To secure the dispersion stability with time, conventionally, a method is proposed for making a diameter of the dispersed water particles fine or adding a stabilization agent. Refer, for example, to Jpn. Pat. Appln. KOKAI Publication No. 2-105890.

However, as regards the production of the emulsion fuel, in the case of the use of the foregoing static mixer, a sufficient fine mixture may not be achieved.

There is such a problem that the high-pressure homogenizer produces a small production quantity although the energy quantity to be consumed in producing the emulsion fuel is large, and the cost of the production apparatus increases.

Regarding the heavy gravity oil, the high shearing mixer is used as a means for dispersing the water into a fuel oil. However, a big-sized agitation blade becomes required to sufficiently disperse the water into the fuel oil if only an agitation operation caused by high-speed rotation of the agitation blade of the high shearing mixer is used, wherein the load on the mixer is made heavy, the replacement frequency of the agitation blade is increased, and electricity expenses are high.

When the emulsion production apparatus agitates in a single rotating stream by the agitation blade, it is hard to evenly mix the oil with the water in a short time and hard to precisely control the moisture content of the emulsion fuel, since rough particle liquid droplets with large mass are adhere to the inner wall of an agitation vessel by the centrifugal force. Especially, in the case of a high-viscosity fuel oil such as C heavy oil, it is hard to evenly mix it with the water in a short time.

Further, to agitate and mix the high-viscosity fuel such as the C heavy oil in the single rotating stream by the agitation blade, it is necessary to heat the fuel oil at around 140° C. to enhance the liquidity, and thus it is impossible to use low-quality fuel without requiring expenses, since energy, time and a facility for heating are needed.

Although it is necessary to add an emulsion agent of around several percent to the fuel oil, the mixture of the emulsion agent of around several percent gives rise to a problem to raises a price of the emulsion fuel and to make the emulsion agent adversely affects the burning of the emulsion fuel.

The present invention is made by taking such a situation into account, and an object of the present invention is to provide an emulsion production apparatus capable of producing the emulsion fuel with high performance and stability.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF SUMMARY OF THE INVENTION

An emulsion production apparatus according to an embodiment of the present invention includes: a cylindrical vessel; a mixture liquid pipe which is disposed on substantially a central shaft of the vessel, to which at least two kinds of liquid are supplied from an upper end, and mixes the liquid to discharge at an portion over a bottom part of the vessel; a rotary hollow shaft which is arranged concentrically with the mixture liquid pipe and disposed rotatably in the vessel; a first rotor which is composed of a plurality of blades radially fixed to a lower end of the hollow shaft and a conical bottom plate to which lower ends of the blades are fixed and forms radial flow paths to introduce the mixture liquid discharged from an lower end of the liquid pipe into an inner wall direction of the vessel among the plurality of blades; a second rotor which is composed of a plurality of blades radially fixed to an upper portion of the hollow shaft; an intermediate support body which is fixed to an inner wall of the vessel between the first and the second rotors, supports the hollow shaft rotatably and in which a plurality of passing holes to pass the mixture liquid are disposed; and a drive means for rotating and driving the hollow shaft.

In the above emulsion production apparatus, the hollow shaft is rotatably supported by a first bearing disposed in an upper end fixing plate of the vessel and by a second bearing disposed in a cylindrical intermediate support body disposed in the vessel between the first rotor and the second rotor.

In the above emulsion production apparatus, the first rotor includes a first rotating body fixed to the hollow shaft and a conical bottom plate fixed to a lower part of the first rotating body, and upper ends and lower ends of the plurality of blades are coupled with the first rotating body and the conical bottom plate, respectively, and a lower end of the liquid pipe is opened to a space to be formed by the first rotating body and the conical bottom plate.

In the above emulsion production apparatus, the second rotor includes a second rotating body fixed to the hollow shaft in a space between an upper fixed plate and the cylindrical support body of the vessel and the plurality of blades are fixed to a periphery of the second rotating body.

In the above emulsion production apparatus, the apparatus further includes a plurality of long holes which are formed in the cylindrical support body and mutually communicate between the first rotor and the second rotor.

In the above emulsion production apparatus, the hollow shaft rotates at such a high speed as of a rotation frequency of 10,000 rpm or more.

In the above emulsion production, the hollow shaft is disposed on a lower side of the vessel, the apparatus further includes a motor of which the rotary shaft is connected to the conical bottom plate of the first rotor.

In the above emulsion production apparatus, the apparatus further includes each of twelve blades which are set upright at equal angles at the first rotor and the second rotor, respectively.

In the above emulsion production, the liquid pipe includes an upper end which is branched into a fork.

In the above emulsion production apparatus, the two kinds of liquid are oil and water.

In the above emulsion production apparatus, the oil is light oil, heavy oil or heavy gravity oil.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, an optimal embodiment of an emulsion production apparatus will be described with reference to the drawings.

Figure 1:
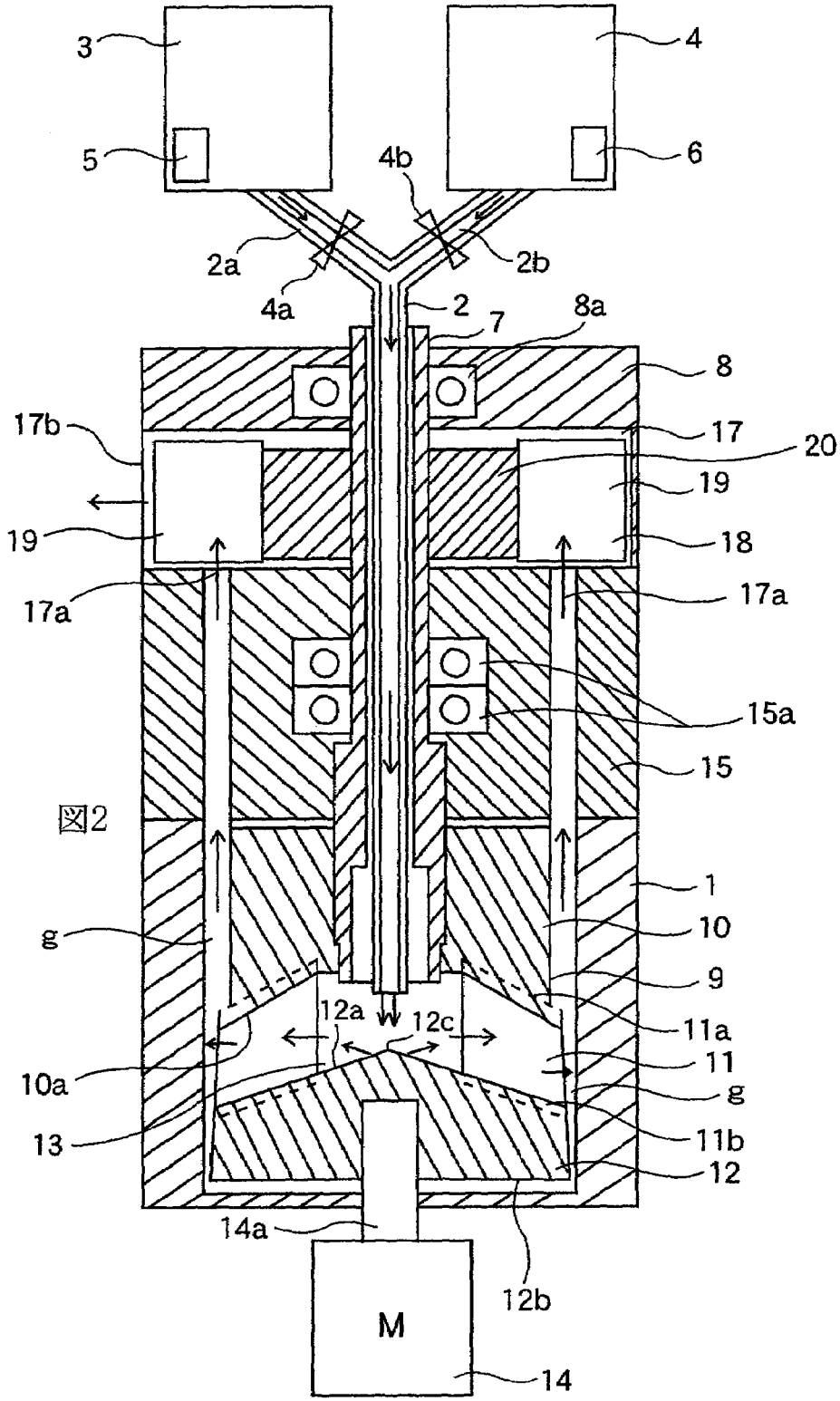
FIG. 1 is a sectional view illustrating an embodiment of an emulsion production apparatus according to an embodiment of the present invention.

FIG. 1 shows a sectional view illustrating an embodiment of the emulsion production apparatus according to the present invention.

As depicted in FIG. 1, a basic configuration of the emulsion production apparatus is provided with a mixture liquid pipe 2 which is vertically extended and mixes an oil (such as a light oil, a heating oil, an A heavy oil) with water to transfer the mixture along with a center shaft of a cylindrical vessel 1. The upper part of the liquid pipe 2 is branched in the form of a character Y to pipes 2*a* and 2*b*, to each of which an oil tank 3 and a water tank 4 are respectively connected. Namely, the liquid pipe 2 is made of stainless-steel, and the branch pipes 2*a* and 2*b* are provided with a flow regulation valve 4*a* and 4*b* , respectively. One ends of the branch pipes 2*a* and 2*b* are piped to the bottom part of the oil tank 3 and the bottom part of the water tank 4 through the flow regulation valves 4*a* and 4*b*, respectively. Both the oil tank 3 and the water tank 4 are made of stainless-steel, and the insides of the oil and water tanks 3 and 4 have heaters 5 and 6 built-in so as to keep liquid temperatures of the liquid (water or oil) stored therein at prescribed temperatures, respectively.

Figure 2:
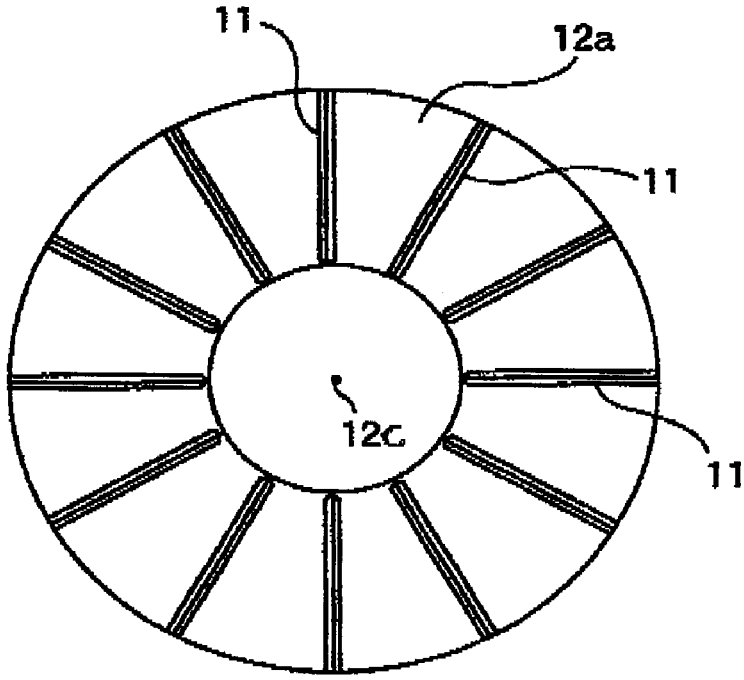
FIG. 2 is a plane view illustrating an arrangement of paddles of a first rotor composed of the emulsion production apparatus shown in FIG. 1.

A rotary hollow shaft 7 is concentrically disposed outside the liquid pipe 2 and is rotating at high speed around the liquid pipe 2. The upper part of the hollow shaft 7 is supported by a fixed plate 8 via a first bearing 8*a* so as to be freely rotatable, and the lower part of the hollow shaft 7 is fixed to a cylindrical first rotating body 10 of a first rotor 9. The first rotor 9 is made of stainless-steel and is provided with twelve plate-like first paddles 11, which are radially fixed on the lower face 10*a* of the first rotating body 10 as the plane view is shown in FIG. 2. A conical bottom plate 12 which is integrally formed with the first rotor 9 is disposed below the first rotor 9. The bottom plate 12 has a conical upper face 12*a* and a plane bottom face 12*b*. The top portion 12*c* of the conical upper face 12*a* is disposed facing the lower end of the liquid pipe 2, and the top angle is formed almost 60°. A first chamber 13 is formed between the lower face 10*a* of the first rotating body 10 of the first rotor 9 and the conical upper face 12*a* of the conical bottom plate 12, and the periphery of the chamber 13 is radially divided by the twelve first paddles 11. The upper sides 11*a* of the first paddles 11 are planted on the lower face 10*a* of the first rotating body 10 and the lower sides 11*b* of the first paddles 11 are planted on the inclined upper face 12*a* of the conical bottom plate 12. The first rotor 9 is composed of the first rotating body 10, the twelve first paddles 11 and the conical bottom plate 12. A gap g is formed as a flow path between the periphery of the first rotor 9 and the side wall of the cylindrical vessel 1. The conical bottom plate 12 is directly connected to a rotary shaft 14*a* of a motor 14 installed at the lower part on the outside of the cylindrical vessel 1.

Figure 3:
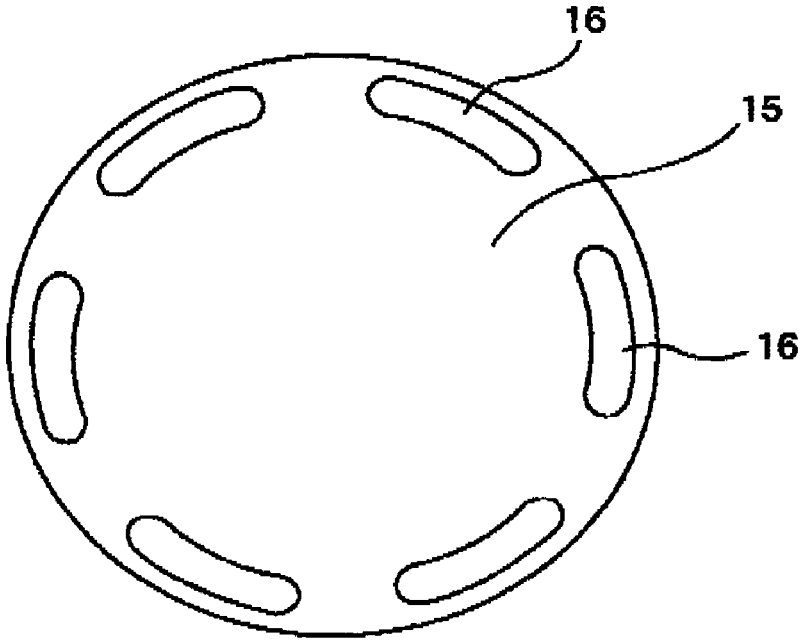
FIG. 3 is a plane view illustrating an arrangement of long holes in a support body composed of the emulsion production apparatus shown in FIG. 1.

A substantially central part of the hollow shaft 7 is received by means of the bearing 15*a* disposed in a cylindrical intermediate support body 15 which has been integrally fixed to the cylindrical vessel 1. The cylindrical support body 15 is provided with six long holes (orifices) 16 at even intervals along the circumference direction as the horizontal sectional view of the support body 15 is shown in FIG. 3. These long holes 16 compose of a flow path for liquid between the periphery of the first rotor 9 and the side wall of the cylindrical vessel 1 together with the gap g as the flow path.

A second chamber 17 is disposed over the cylindrical intermediate support body 15. The second chamber 17 forms a cylindrical closed space between the fixed plate 8 and the support body 15 so as to form a part of the cylindrical vessel 1. A second rotor 18 integrally rotating with the hollow shaft 7 at high speed is installed in the second chamber 17.

In the same way as the first rotor 9 depicted in FIG. 2, in the second rotor 18, twelve plate-like second paddles 19 are also radially fixed to the periphery of the second rotor 18. An inflow port 17*a* is formed on the bottom face in the second chamber 17, through which the liquid passed the six long holes 19 disposed in the intermediate support body 15 is supplied. An outflow port 17*b* is formed on the side face of the second chamber 17 to discharge the liquid, which has been supplied into the second chamber 17, out of the cylindrical vessel 1. The second rotor 18 and the first rotor 19 are similarly made of stainless-steel, and all the faces of the second paddles 19 are mirror finished.

The following will describe operations of the emulsion production apparatus above configured. Every arrow in FIG. 1 indicates the directions of the flow of the liquid. The first paddles 11 of the first rotor 9 disposed at the lower part of the liquid pipe 2 supply the mixture liquid of the water and the oil which freely drop along the liquid pipe 2 with shearing force to crush the mixture liquid and to atomize the mixture liquid to produce the emulsion fuel.

In other words, the motor 14 rotates the rotary hollow shaft 7 at high speed of 15,000 rpm through a power transmission mechanism. Therefore, both the first and the second rotors fixed to the hollow shaft 7 also rotate at the high speed of 15,000 rpm. It is preferable for the rotation frequency of the hollow shaft 7 to be at least 10,000 rpm or more.

In contrast, the liquid temperature of the liquid (e.g., a light oil and water) stored in the oil tank 3 and the water tank 4 is maintained at about 55° C. by means of the heater 6. Each liquid in the tanks 3 and 4 passes through the flow regulation valves 4*a* and 4*b* from the branch pipes 2*a* and 2*b*, respectively, and flows into the liquid pipe 2, turning into the mixture liquid of the water and the oil in the liquid pipe 2, and the mixture liquid freely drops along the liquid pipe 2.

Each liquid flowing into the liquid pipe 2 is so regulated by the regulation valves 4*a* and 4*b* that the ratio between the water and the oil in mixture liquid which freely drops inside the liquid pipe 2 is expressed by 'water: oil=40:60' in a volume ratio.

The mixture liquid which is freely dropped inside the liquid pipe 2 flows into the first chamber 13, collides with the upper face 12*a* of the conical bottom plate 12 to fly in circumferential directions, and flows into the flow paths divided by the first paddles 11. Since the first paddles 11 rotates, the mixture liquid is crashed by the first paddles 11 and converted into the emulsion fuel containing fine particles each having a particle diameter of around 5 μm. Further, the converted emulsion fuel collides with the side wall of the cylindrical vessel 1 by centrifugal force from the first rotor 9 and rises in the gap g formed between the cylindrical vessel 1 and the first rotor 9 to collide with the lower face of the intermediate support body 15.

Since the long holes 16 are formed to compress and pass the emulsion fuel as shown in FIG. 3, the emulsion fuel is converted from an expansion state into a compression state when passing through the long holes 16. The emulsion fuel which has passed though the long hole 16 and has been in the compression state then flows into the second chamber 17 through the inflow port 17*a*. Since the second rotor 18 rotating at high speed is disposed in the second chamber 17, the emulsion fuel which has flowed into the second chamber 17 collides with the second paddle 19 to be further crashed and atomized. The atomized emulsion fuel flows out of the second chamber 17 through the outflow port 17*b* disposed on the side face of the second chamber 17, and is supplied, for example, to a burner of a boiler.

Obtaining the emulsion fuel extracted in the manner mentioned above and measuring the averaged value of micelle aggregate by means of a particle distribution measuring device in a laser light dispersion system result in the value of a diameter of 0.1 μm. As a result of observation of this emulsion fuel for a month in a stationary state, any separation is not recognized, and it is confirmed that the emulsion fuel is extremely excellent in stability.

The aforementioned emulsion production apparatus may be utilized for producing edible emulsion. It goes without saying that the production apparatus may be carried out in the state in which various improvements which have been easily thought by those skilled in the art are applied.

It is our intention that the invention is not limited to the specific details and representative embodiments shown and described herein, and in an implementation phase, this invention may be embodied in various forms without departing from the spirit or scope of the general inventive concept thereof. Various types of the invention can be formed by appropriately combining a plurality of constituent elements disclosed in the foregoing embodiments. Some of the elements, for example, may be omitted from the whole of the constituent elements shown in the embodiments mentioned above. Further, the constituent elements over different embodiments may be appropriately combined.

What is claimed is:

1. An emulsion production apparatus comprising:

a cylindrical vessel;

a mixture liquid pipe which is disposed on substantially a central shaft of the vessel, to which at least two kinds of liquid are supplied from an upper end, and mixes the liquid to discharge at an portion over a bottom part of the vessel;

a rotary hollow shaft which is arranged concentrically with the mixture liquid pipe and disposed rotatably in the vessel;

a first rotor which is composed of a plurality of blades radially fixed to a lower end of the hollow shaft and a conical bottom plate to which lower ends of the blades are fixed and forms radial flow paths to introduce the mixture liquid discharged from an lower end of the liquid pipe into an inner wall direction of the vessel among the plurality of blades; a second rotor which is composed of a plurality of blades radially fixed to an upper portion of the hollow shaft;

an intermediate support body which is fixed to an inner wall of the vessel between the first and the second rotors, supports the hollow shaft rotatably and in which a plurality of passing holes to pass the mixture liquid are disposed; and a drive means for rotating and driving the hollow shaft.

2. The emulsion production apparatus according to claim 1, wherein the hollow shaft is rotatably supported by a first bearing disposed in an upper end fixing plate of the vessel and by a second bearing disposed in a cylindrical intermediate support body disposed in the vessel between the first rotor and the second rotor.

3. The emulsion production apparatus according to claim 2, wherein the first rotor includes a first rotating body fixed to the hollow shaft and a conical bottom plate fixed to a lower part of the first rotating body, and upper ends and lower ends of the plurality of blades are coupled with the first rotating body and the conical bottom plate, respectively, and a lower end of the liquid pipe is opened to a space to be formed by the first rotating body and the conical bottom plate.

4. The emulsion production apparatus according to claim 3, wherein the second rotor includes a second rotating body fixed to the hollow shaft in a space between an upper fixed plate and the cylindrical support body of the vessel and the plurality of blades are fixed to a periphery of the second rotating body.

5. The emulsion production apparatus according to claim 3, further comprising a plurality of long holes which are formed in the cylindrical support body and mutually communicate between the first rotor and the second rotor.

6. The emulsion production apparatus according to claim 5, wherein the hollow shaft rotates at high speed of a rotation frequency of 10,000 rpm or more.

7. The emulsion production apparatus according to claim 6, wherein the apparatus further comprises a motor of which the rotary shaft is connected to the conical bottom plate of the first rotor.

8. The emulsion production apparatus according to claim 7, wherein the liquid pipe includes an upper end which is branched into a fork.

9. The emulsion production apparatus according to claim 6, further comprising each of twelve blades which are set upright at equal angles at the first rotor and the second rotor, respectively.

10. The emulsion production apparatus according to claim 9, wherein the two kinds of liquid are oil and water.

11. The emulsion production apparatus according to claim 10, wherein the oil is light oil, heavy oil, or heavy gravity oil.

* * * * *